US011287120B2

(12) United States Patent
Jiang et al.

(10) Patent No.: US 11,287,120 B2
(45) Date of Patent: Mar. 29, 2022

(54) DIRECT-TYPE PANEL LAMP WITH DRIVING BOX AND PACKAGE STRUCTURE THEREOF

(71) Applicant: CH LIGHTING TECHNOLOGY CO., LTD., Shaoxing (CN)

(72) Inventors: Jiangfeng Jiang, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/172,014

(22) Filed: Feb. 9, 2021

(65) Prior Publication Data

US 2021/0310646 A1 Oct. 7, 2021

(30) Foreign Application Priority Data

Apr. 1, 2020 (CN) ..... 202020461417.9
Nov. 27, 2020 (CN) ..... 202022808469.1
Nov. 27, 2020 (CN) ..... 202022810894.4

(51) Int. Cl.
*F21V 23/00* (2015.01)
*F21V 3/02* (2006.01)
*F21Y 105/10* (2016.01)
*F21Y 115/10* (2016.01)

(52) U.S. Cl.
CPC ..... *F21V 23/007* (2013.01); *F21V 3/02* (2013.01); *F21Y 2105/10* (2016.08); *F21Y 2115/10* (2016.08)

(58) Field of Classification Search
CPC ..... F21V 23/007; F21V 3/02; F21V 23/008; F21Y 2105/10; F21Y 2115/10; F21S 4/00; F21S 8/04; G02F 1/133603; G02F 1/133608; G02B 6/0076
See application file for complete search history.

(56) References Cited

U.S. PATENT DOCUMENTS 8,272,763 B1 * 9/2012 Chinnam ..... F21V 17/107 362/249.07
9,206,948 B1 * 12/2015 Scribante ..... F21V 21/03
2013/0058105 A1 * 3/2013 Lee ..... F21V 15/01 362/363
2016/0320044 A1 * 11/2016 Romano ..... F21V 29/77
2021/0080069 A1 * 3/2021 Bao ..... F21V 23/06

* cited by examiner

*Primary Examiner* — Peggy A Neils

(57) ABSTRACT

A direct-type panel lamp with a driving box and a package structure, including a frame, a diffusion plate, a back plate, a driving box and a lamp strip. A central region of the back plate bulges to form a chamber for accommodating the lamp strip. The chamber includes a flat bottom wall and inclined side walls. The diffusion plate is arranged opposite to the back plate to close the chamber. The frame is formed by connecting a number of frame strips, each frame strip is connected with respective edges of the diffusion plate and the back plate. The driving box is configured to receive a driving module electrically connected to the lamp strip. The driving box includes a box body with an opening and a top cove buckled over the opening. The box body has a through hole for wire through which a connecting wire of the driving module passes.

19 Claims, 11 Drawing Sheets

DIRECT-TYPE PANEL LAMP WITH DRIVING BOX AND PACKAGE STRUCTURE THEREOF

TECHNICAL FIELD

The present application relates to the field of panel lamps, and particularly to a direct-type panel lamp with a driving box and a package structure thereof.

BACKGROUND

LED panel lamps have the advantages of good illuminance uniformity, soft and comfort light, environmental protection, small power consumption and the like, and is a kind of popular indoor lighting luminaire.

A basic structure of the panel lamp includes a frame, a back plate, a diffusion plate, a driving power supply and a plurality of light emitting assemblies. The back plate is mounted on the back of the frame, and the diffusion plate is mounted on the front of the frame. The back plate has a chamber, wherein the chamber includes a flat bottom wall and an inclined side wall. Each light emitting element is fixed on the bottom wall. The driving power supply is mounted on one backlight side of the panel lamp. The light emitting assemblies exhibit a uniform plane light emitting effect after passing through the diffusion plate with high light transmittance.

A driving module is electrically connected with a light emitting element by a connecting wire, and configured to drive the light emitting element. After the driving module is damaged, there is a need for removing the driving module from the direct-type panel lamp for replacement. At this time, it is necessary to remove a screw between the driving module and the direct-type panel lamp and then replace the driving module. As a result, the step of maintaining or replacing the driving module is cumbersome and thus increasing time and labor costs.

SUMMARY

In order to solve the above-mentioned problems, the present application provides a direct-type panel lamp with a driving box, which can achieve the effect of quickly replacing a driving module.

The present application provides a direct-type panel lamp with a driving box, comprising:

at least one lamp strip, comprising a substrate and a plurality of LED beads fixed on the substrate:

a back plate, with a central region bulging to form a chamber for accommodating the lamp strip, the chamber comprises a flat bottom wall and a plurality of inclined side walk, and each lamp strip is fixed on the bottom wall;

a diffusion plate, having a light transmitting function, and arranged opposite to the back plate to close the chamber;

a frame, formed by connecting a plurality of frame strips, and each frame strip is connected with respective edges of the diffusion plate and the back plate; and a driving box, configured to receive a driving module electrically connected to the lamp strip, the driving box comprises a box body with an opening and a top cove buckled to the opening of the box body, and the box body is provided with a through hole for wire through which a connecting wire of the driving module passes.

The following further provides a number of alternatives, and is merely intended as further additions or preferences rather than additional limitations on the above-mentioned overall solution. With respect to the above-mentioned overall solution, the alternatives may be combined separately without technical or logical contradictions, and may be combined together.

the box body is arranged in a strip shape, having a convex pentagonal cross section, the convex pentagon comprises a first side, a second side, a third side, a fourth side and a fifth side which are arranged in sequence, wherein the first side is arranged parallel to the third side, the second side is perpendicular to the first side and the third side, and a box wall corresponding to the first side is attached to the frame, and a box wall corresponding to the fifth side is attached to the back plate.

Optionally, the first side has a length equal to a length of the third side, and the fourth side has a length equal to the length of the third side.

Optionally, the back plate is provided with a slope region on an outer periphery thereof, and a box wall corresponding to the fifth side is corresponding to the slope region.

Optionally, an angle of inclination of the slope region and an angle of inclination of the box wall corresponding to the fifth side are the same, and the slope region and the box wall corresponding to the fifth side conform each other.

Optionally, the driving box is located on an outer periphery of the back plate, and a top surface of the driving box is higher than the back plate.

Optionally, lugs with screw holes are disposed on two ends of the driving box; and wherein the lugs are connected to a box wall corresponding to the first side.

Optionally, the through hole for wire is provided in the box wall corresponding to the fourth side;

the driving box further comprises a cover plate mounted on the box body and corresponding to the through hole for wire, and a plurality of unit holes aligned with the through hole for wire are provided in the cover plate.

Optionally, a plurality of unit covers are further disposed on the cover plate, and the plurality of unit covers are respectively arranged corresponding to the unit holes;

the unit covers are connected with inner edges of the unit holes by deformable connectors.

Optionally, the direct-type panel lamp further includes an insulating box mounted within the driving box, wherein the driving module is mounted within the insulating box.

Optionally, the insulating box is of a strip shape, wherein at least one end of the insulating box is opened in the driving box, and the open end is configured to allow the connecting wire of the driving module to pass through.

Optionally, the insulating box has a rectangular cross section, and the rectangle shape is closed in a circumferential direction;

in two opposite side walls of the insulating box, one of the two opposite side walls of the insulating box is attached and fixed to a side wall of the box body, and the other one of the two opposite side walls of the insulating box is fixedly connected with the driving module.

Optionally, the driving box is of a strip shape, and a length direction of the driving box is the same as that of the insulation box;

one end of the insulating box is adjacent to one end portion of the driving box, and a wire through chamber is formed between the other end of the insulating box and the other end portion of the driving box, and the through hole for wire is communicated with the wire through chamber.

Optionally, the through hole for wire and the insulating box are located on the same side wall of the box body, and the through hole for wire and the insulating box are arranged in sequence along a length direction of the driving box.

Optionally, the length of the driving box is D1, and the length of the insulating box is D2, and the following condition is met: D1:D2=1.5 to 3.

Optionally, the cross-sectional area of the driving box is S1, the cross-sectional area of the insulating box is S2, and the following condition is met: S1:S2=1.2 to 2.

Optionally, the frame strip has an L-shaped cross section, including a horizontal portion and a vertical portion, a mounting region is formed between the vertical portion and an outer periphery of the back plate, and the driving box is disposed in the mounting region.

In combination with structural characteristics of the direct-type panel lamp and the driving box thereof, the present application further provides a package structure of the panel lamp, wherein the panel lamp may employ the direct-type panel lamp described in the present application, and the driving box has two assembling surfaces arranged parallel to each other;

the package structure includes two panel lamps with back plates placed opposite to each other, the two assembling surfaces of the driving box of each panel lamp are respectively attached to the frames of the two panel lamps, and the back plates of the two panel lamps are in contact with each other or arranged with a gap is reserved between the back plates, wherein a gap distance is less than 10 mm.

Based on the same concept, the present application further provides a package structure for a panel lamp, wherein the panel lamp includes a frame, a light transmissive plate mounted on a front side of the frame, a back plate mounted on a back side of the frame, and a light emitting element arranged between the back plate and the light transmissive plate; and the panel lamp further comprises a driving box fixed on the back side of the frame, wherein the driving box is provided with driving circuit electrically connected with the light emitting element, and the driving box has two assembling surfaces arranged parallel to each other; and the package structure comprises two panel lamps with back plates placed opposite to each other, the two assembling surfaces of each driving box are attached to the frames of the two panel lamps, the back plates of the two panel lamps are in contact with each other or arranged with a gap formed between the back plates, wherein a gap distance is less than 10 mm.

Optionally, the driving box further has a positioning surface disposed between the two assembling surfaces, and the positioning surface is attached to inner sides of edges of the frames of the two panel lamps.

Optionally, the back plate is provided with a bulging portion on one side which faces away from the light transmissive plate, and the driving box is located on an outer periphery of the bulging portion and a top surface of the driving box is higher than the bulging portion.

Optionally, the driving box has an abutting portion higher than the bulging portion of the panel lamp, one side of the abutting portion which faces the center of the frame serves as a limiting surface, and one panel lamp abuts against an outer periphery of the bulging portion of the other panel lamp at a limiting surface on the driving box thereof.

Optionally, a slope region is disposed on an outer peripheral wall of the bulging portion, and the slope region is corresponding to the limiting surface of the other panel lamp.

Optionally, inclination angles of the slope region and the limiting surface which are corresponding to each other are the same and the slope region and the limiting surface conform each other.

Optionally, a mounting region and an accommodating region are formed between the frame and the back plate, the mounting region is configured to mount the driving box of one panel lamp, and the accommodating region is configured to accommodate a driving box of the other panel lamp.

Optionally, the accommodating region and the mounting region are communicated with each other in an annular arrangement.

Optionally, each frame is formed by connecting a plurality of frame strips, each frame strip has an L-shaped cross section, comprising a horizontal portion and a vertical portion, and the edge of the back plate and the edge of the light transmissive plate are overlapped on the horizontal portion, a mounting region and an accommodating region are formed between the vertical portion and an outer periphery of the bulging portion.

Optionally, the driving boxes of the two panel lamps are respectively located on two opposite sides of the package structure.

By mounting the driving module within the driving box, the direct-type panel lamp of the present application facilitates the fixation and the protection of the driving module, and is capable of simplifying the step of maintaining or replacing the driving module, thereby lowering time and labor costs.

When the two panel lamps are packaged, the package structure of the present application undergoes an action force between the two panel lamps by means of the two driving boxes, so as to prevent the back plates on the two panel lamps from deforming due to the action force.

Figure 1:
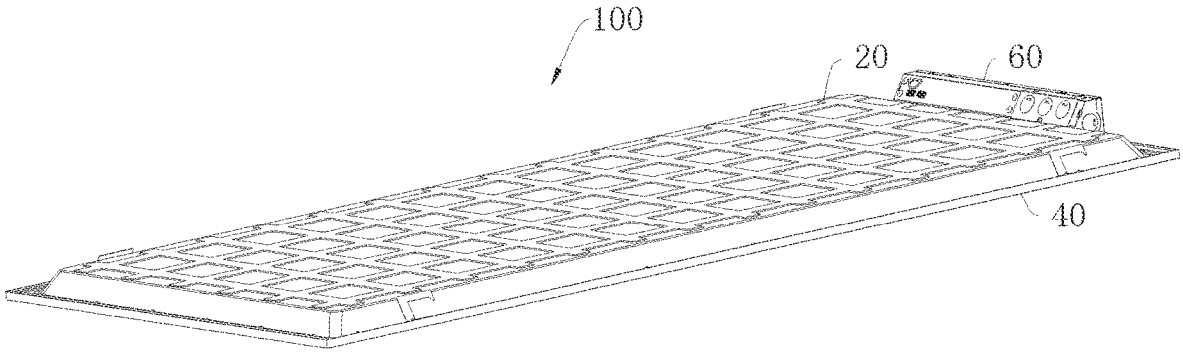
FIG. 1 is a schematic view showing a structure of a direct-type panel lamp according to an embodiment provided by the present application.

Reference numerals in accompanying drawings are illustrated as follows.

100. direct-type panel lamp; 101. driving module;

10. lamp strip; 11. substrate; 111. metal layer; 112. insulating layer; 113. circuit layer; 114. second opening; 115. pad; 12. LED bead; 13. lens; 131. protruding leg; 14. flexible strip; 141. first opening; 142. insulating layer; 143. circuit layer; 144. solder resist layer; 15. first LED bead; 16. second LED bead;

20. back plate; 211. protrusion; 22. edge region; 221. central region; 23. chamber; 231. bottom wall; 232. side wall; 24. protruding rib; 25. slope region;

30. diffusion plate;

40. frame; 41. frame strip; 42. first mounting surface; 43. second mounting surface; 44. horizontal portion; 45. vertical portion; 46. thickening portion; 47. vertical flange; 471. screw groove;

50. reflective sheet; 51. central region; 52. folded edge; 53. cut-out; 54. avoiding hole; 55. repair hole;

60. driving box; 61. box body; 611. wire through chamber; 612. through hole for wire; 62. top cover; 63. cover plate; 631. unit hole; 632. unit cover; 633. shielding portion; 634. fixing portion; 64. first side; 641. second side; 642. third side; 643. fourth side; 644. fifth side; 65. lug; 66. insulating box;

70. panel lamp; 71. frame; 711. frame strip; 712. horizontal portion; 713. vertical portion; 714. screw groove; 72. light transmissive plate; 73. back plate; 731. bulging portion; 732. slope region; 74. light emitting element; 75. driving box; 751. first assembling surface; 752. second assembling surface; 753. positioning surface; 754. abutting portion; 755. limiting surface; 756. lug; 76. mounting region; 77. accommodating region;

80. package structure.

DESCRIPTION OF THE EMBODIMENTS

The following will clearly and completely describe technical solutions in embodiments of the present application in conjunction with accompanying drawings in the embodiments of the present application. Obviously, embodiments described are only a part of embodiments of the present application, and are not all of embodiments thereof. Based on the embodiments in the present application, all other embodiments obtained by those ordinarily skilled in the art without paying any creative efforts fall within the protection scope of the present application.

It should be noted that when an assembly is referred to be "connected" with another assembly, it may be directly connected with the other assembly or there may be an intervening assembly. When an assembly is considered to be "disposed" on another assembly, it may be directly disposed on another assembly or there may be an intervening assembly.

Unless otherwise defined, all technical and scientific terms used herein have the same meaning as commonly understood by those skilled in the technical field to which the present application belongs. The terms used in the specification of the present application herein are only for the purpose of describing specific embodiments, and are not intended to limit the present application. The term "and/or" as used herein includes any and all combinations of one or more of the related listed items.

As shown in FIGS. 1 to 7, the present application provides a direct-type panel lamp 100, which includes a frame 40, a back plate 20, a diffusion plate 30, and at least one lamp strip 10. A central region 221 of the back plate 20 bulges to form a chamber 23 for accommodating the lamp strips 10, the chamber 20 includes a flat bottom wall 231 and inclined side walls 232, and each lamp strip 10 is fixed on the bottom wall 231.

The diffusion plate 30 is disposed opposite to the back plate 20 to close the chamber 23. The frame 40 is formed by connecting a number of (generally, four) frame strips 41, and each frame strip 41 is connected with respective edges of the diffusion plate 30 and the back plate 20.

The lamp strip 10 includes a substrate 11, LED beads 12 fixed on the substrate 11, and lenses 13 covering the LED beads 12. The diffusion plate 30 has a light transmitting function. Light emitted by the LED beads 12 pass through the lenses 13 and the diffusion plate 30 in sequence. After the light is diffused, the multiple LED point light sources form a uniform surface light source.

In the prior art, the driving module 101 is configured to drive the lamp strip 10, and the driving module 101 is electrically connected with the lamp strip 10 by connecting wires. If the driving module 101 is damaged, there is a need for removing the driving module 101 from the direct-type panel lamp 100 for replacement. In that case, it is necessary to remove screws between the driving module 101 and the direct-type panel lamp 100 and then replace the driving module 101. In this way, the step of maintaining or replacing the driving module 101 is cumbersome, and thus increasing time and labor costs.

Figure 12:
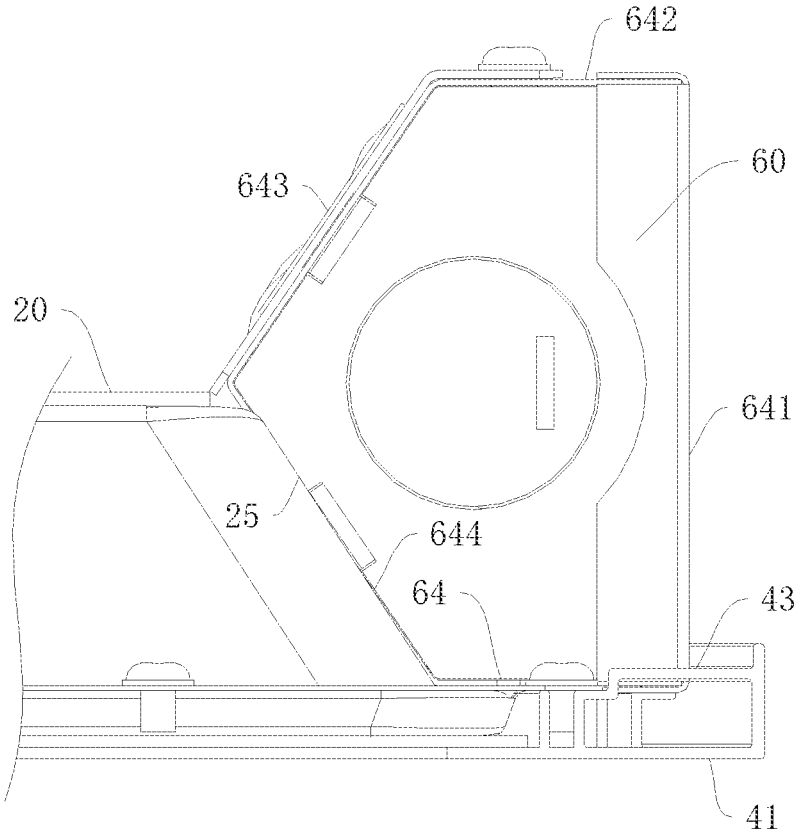
FIG. 12 is a partial schematic view showing a direct-type panel lamp in FIG. 1.
Figure 14:
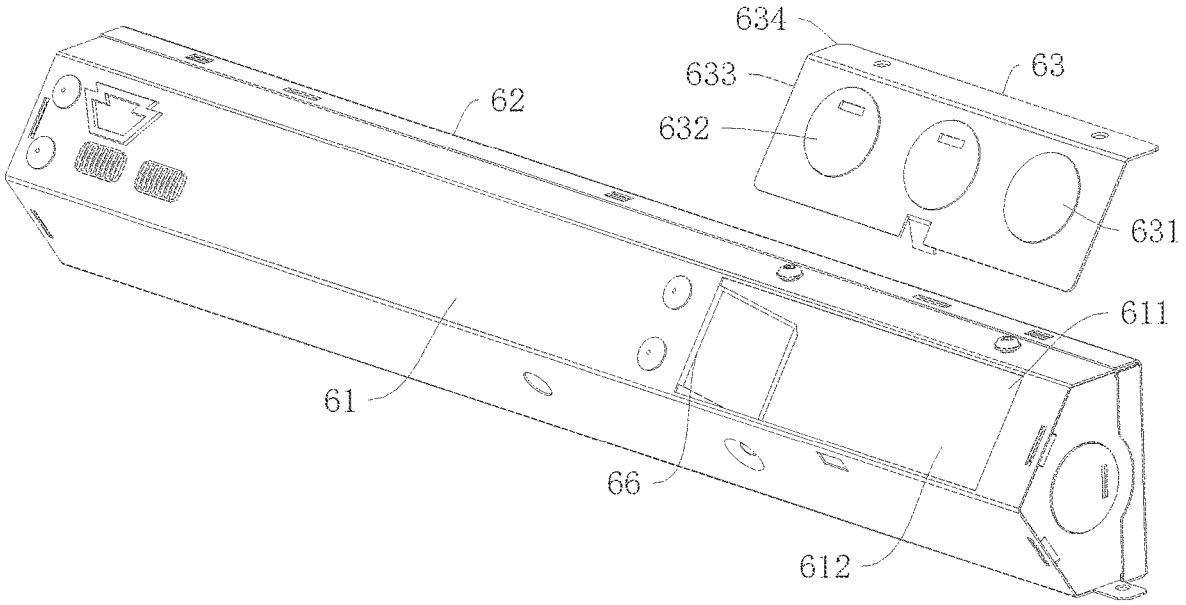
FIG. 14 is a schematic exploded view showing a structure of a driving box in FIG. 13.
Figure 15:
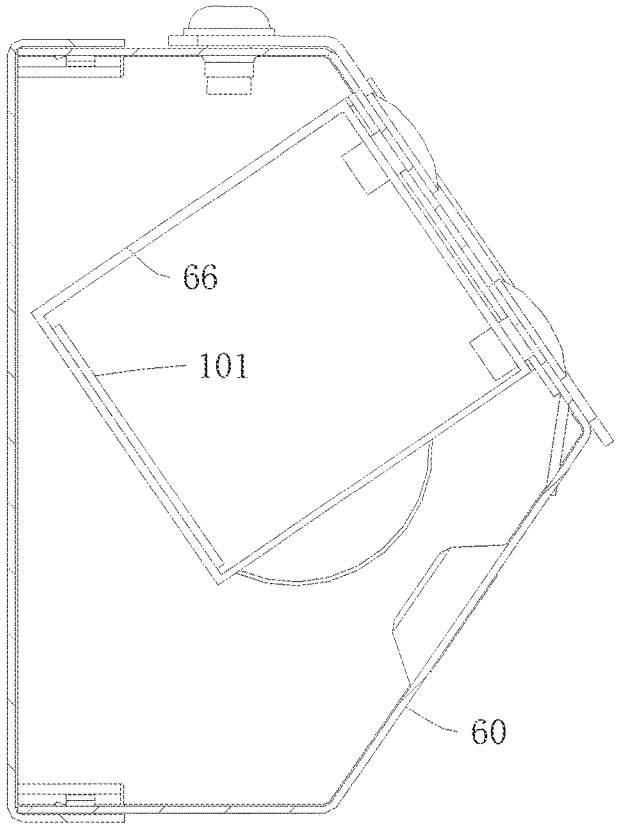
FIG. 15 is a schematic cross-sectional view showing a driving box in FIG. 13.

In one of the embodiments, as shown in FIG. 12, FIG. 14 and FIG. 15, in order to solve the above-mentioned technical problems, the direct-type panel lamp 100 further includes a driving box 60 for accommodating a driving module which is electrically connected with the lamp strip. The driving box 60 includes a box body 61 with an opening, and a top cover 62 buckled to the opening side of the box body 61. The box body 61 is provided with a through hole for wire 612 through which connecting wires of the driving module 101 pass.

In one of the embodiments, as shown in FIG. 12 and FIG. 15, the box body 61 is arranged in a strip shape, with a convex pentagonal cross section. The convex pentagon includes a first side 64, a second side 641, a third side 642, a fourth side 643 and a fifth side 644 which are arranged in sequence, wherein the first side 64 is arranged in parallel with the third side 642, the second side 641 is perpendicular to the first side 64 and the third side 642, a box wall corresponding to the first side 64 is attached to the second mounting surface 43, a box wall corresponding to the fifth side 644 is attached to the back plate 20, and a box wall corresponding to the second side 641 is provided in the form of the opening.

By mounting the driving module 101 within the driving box 60, the present application brings the convenience for fixing and protecting the driving module 101, and is capable of simplifying the step of maintaining or replacing the driving module 101, thereby lowering time and labor costs.

From the perspective of the processing technology and the heat dissipation, the back plate 20 is formed by a metal sheet (for example, ST13) by stamping to form an arched cover structure, which includes a central region 221 and edge regions 22 arranged on the periphery of the central region 221.

With reference to one of the embodiments, in terms of the form of connecting the frame strip 41 with the respective edges of the diffusion plate 30 and the back plate 20, each frame strip 41 has a first mounting surface 42 and a second mounting surface 43 at different levels (the level here refers to a height along a vertical direction when the direct-type panel lamp 100 is in the mounted state). The edge of the diffusion plate 30 is overlapped on the lower first mounting surface 42, and an edge region 22 of the back plate 20 is overlapped on the higher second mounting surface 43 and fixed by fastening screws. The box wall corresponding to the first side 64 is attached to the second mounting surface.

Figure 2:
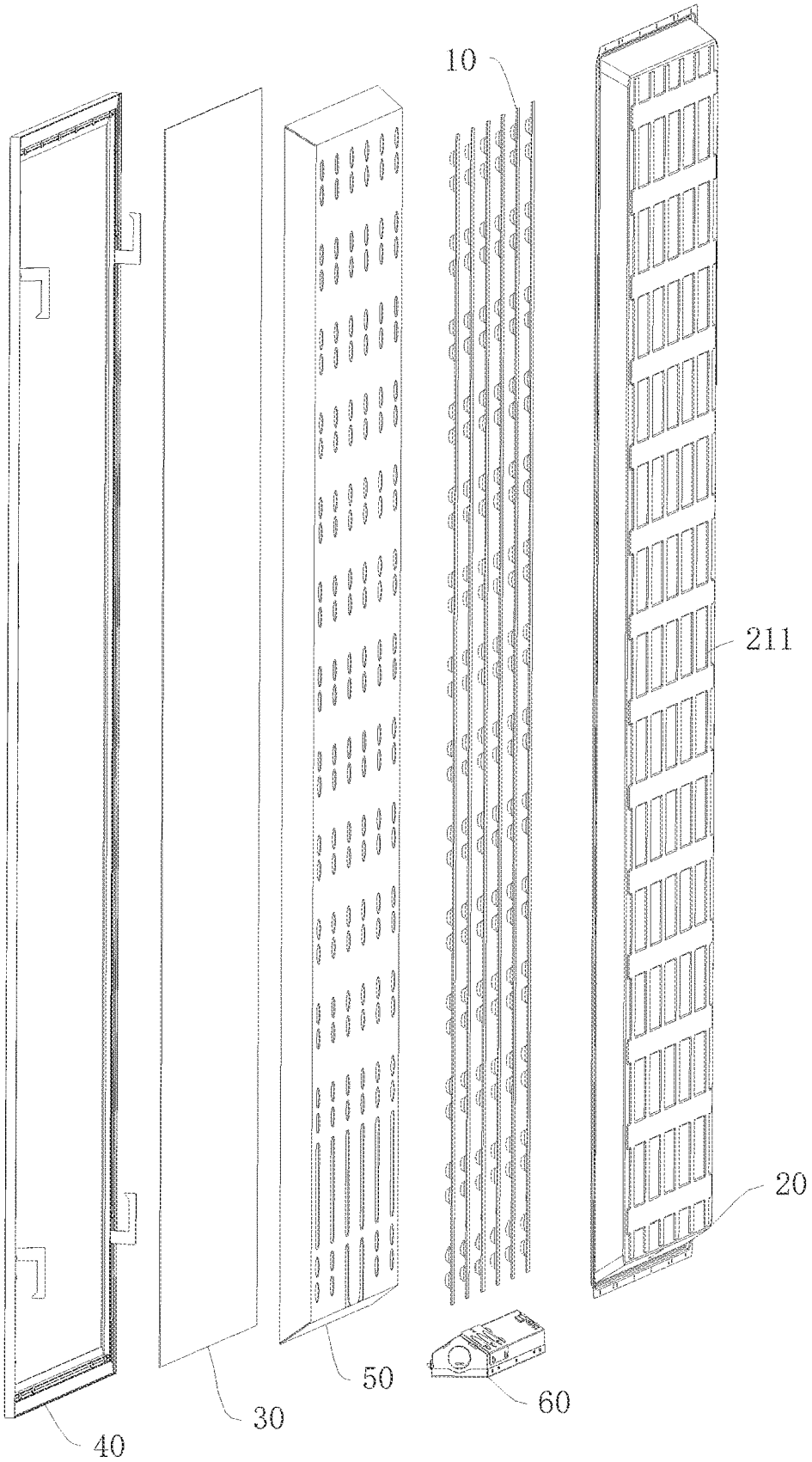
FIG. 2 is a schematic exploded view showing a structure of a direct-type panel lamp in FIG. 1.
Figure 3:
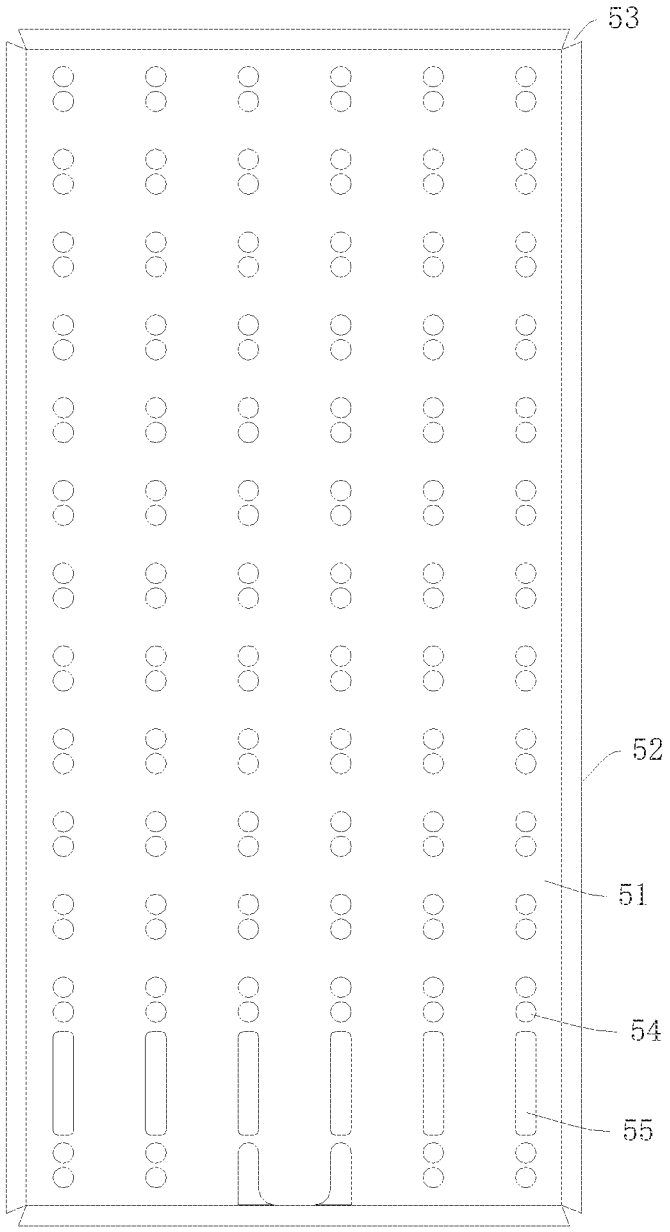
FIG. 3 is a schematic view showing a structure of a reflective sheet in a flat state in FIG. 2.

The panel lamp 100 further includes a reflective sheet 50, which is capable of reflecting light emitted from each lamp strip 10. In some embodiments, as shown in FIG. 2 and FIG. 3, the reflective sheet 50 includes a central region 51 and folded edges 52 extending along side edges of the central region 51. Cut-outs 53 are provided at corners of the folded edges 52. The central region 51 of the reflective sheet 50 is attached to the bottom wall 231. The folded edges 52 are attached to the side walls 232. Two opposite side edges of each cut-out 53 are attached so as to form a box-shaped structure. The cut-outs 53 may prevent the folded edges 52 from wrinkling or folding at the corners of the side walls 232, so that the reflective sheet 50 is smoothly mounted, thereby avoiding causing light spots. The central region 51 and the folded edges 52 of the reflective sheet 50 are fixed to the back plate 20 by means of glue.

The central region 51 of the reflective sheet 50 is formed in a rectangular shape, the number of the folded edges 52 is four, and the folded edges 52 are respectively arranged on the corresponding sides of the central region 51. A cut-out 53 is provided between two adjacent folded edges 52, and each folded edge 52 extends with constant width in a side direction of the central region 51. When the reflective sheet 50 is unfolded in a flat state, a center line of each cut-out 53 coincides with a diagonal line of the central region 51.

With reference to one of the embodiments, the central region 51 covers the bottom wall 231, each folded edge 52 covers the corresponding side walls 232, with two adjacent folded edges 52 not overlapping each other. The width of the folded edge 52 is the same as or slightly smaller than that of the side wall 232, so that the folded edge 52 can cover the corresponding side wall 232 as much area as possible, and can prevent the folded edge 52 from wrinkling and causing unevenness of the reflective sheet 50.

Figure 5:
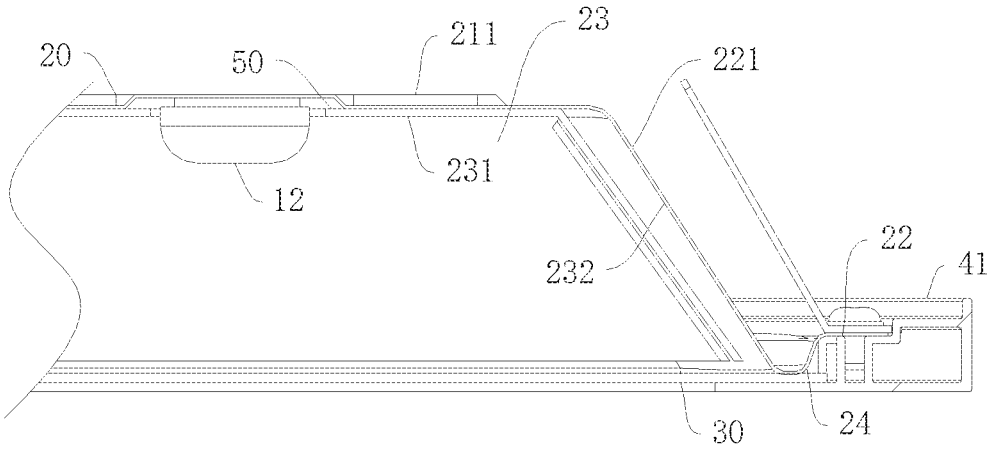
FIG. 5 is a schematic view showing a structure in which a frame strip is omitted in FIG. 1.

With reference to one of the embodiments, as shown in FIG. 2 and FIG. 5, for a mounting position of the reflective sheet 50, the substrates 11 are located between the reflective sheet 50 and the back plate 20, and the reflective sheet 50 is provided with avoiding holes 54 for allowing the LED beads 12 and the lenses 13 to be exposed. The reflective sheet 50 is able to cover the substrates 11 of the lamp strip 10 to prevent from producing a shadow on the substrates 11 which affects the emission of light from the direct-type panel lamp 100. Certainly, in some further embodiments, the substrates 11 may be additionally processed, for example, a white reflective material may be coated on the substrate 11, but it will increase a process flow of the lamp strip 10.

A contour of each avoiding hole 54 is corresponding to that of a respective lens 13, so that the reflective sheet 50 covers the bottom wall 231 as much as possible. In this embodiment, each lens 13 is of a spherical crown shape, and the corresponding avoiding hole 54 is circular. The diameter of the avoiding hole 54 ranges from 15 mm to 35 mm. Preferably, the diameter of the avoiding hole 54 is 20 mm.

If the included angle between two opposite side edges of the cut-out 53 is too large or too small, it will affect a relationship between two opposite side edges of the cut-out 53 when the reflective sheet 50 is in a mounted state (for example, two opposite side edges of the cut-out 53 overlap each other or a gap between two opposite side edges of the cut-out 53 is too large). With reference to one of the embodiments, in order to solve the above-mentioned problem, when the reflective sheet 50 is in an unfolded flat state, an included angle between two opposite side edges of the cut-out 53 ranges from 20 degrees to 90 degrees. Meanwhile, the included angle between the side wall 232 and the bottom wall 231 affects an included angle between two opposite side edges of the cut-out 53 of the side wall 232. Preferably, the included angle between two opposite side edges of the cut-out 53 is 30 degrees.

With reference to one of the embodiments, in order to facilitate the folding of the folded edge 52 relative to the central region 51, a plurality of pores are provided at the fold between the central region 51 and the folded edge 52, which are sequentially provided along an extending direction of the fold. Each pore is strip-shaped, and the pores are arranged along a side direction of the central region 51.

For the specific form of the pores, in one embodiment, the pores are configured in the form of hollows or slits. When the folded edge 52 is bent relative to the central region 51, two sides of the pore can be attached or abutted one another, so as to avoid affecting the reflection of light emitted from the lamp strip 10.

The lamp strips 10 are electrically connected by a flexible strip 14. With reference to one of the embodiments, in order to perform maintenance between the flexible strip 14 and the lamp strip 10, the central region 51 of the reflective sheet 50 is provided with a plurality of repair holes 55. Connecting parts of the lamp strips 10 and the flexible strip 14 are respectively corresponding to the repair holes 55. The connecting parts of the flexible strip 14 and the lamp strips 10 can be repaired through the repair holes 55.

In one of the embodiments, in order to form a certain operating space when the connecting parts of the flexible strip 14 and the lamp strips 10 are repaired, as for each repair hole, along a length direction of the corresponding flexible strip 14, a distance between two opposite edges of the repair hole 55 is greater than the width of the corresponding lamp strip 10. Along a length direction of the corresponding lamp strip 10, a distance between two opposite edges of the repair hole 55 is greater than the width of the corresponding flexible strip 14.

Figure 4:
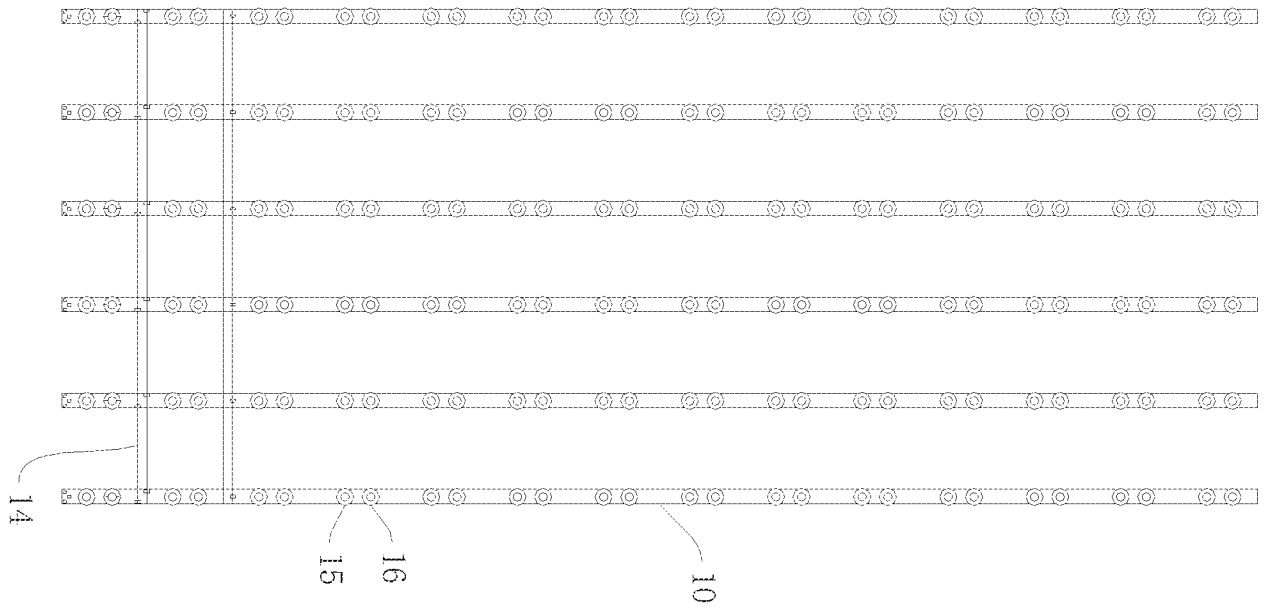
FIG. 4 is a schematic view showing a structure of a lamp strip in FIG. 2.

In some embodiments, as shown in FIG. 2 and FIG. 4, the lamp strips 10 each extend longitudinally and are spaced apart from each other. The LED beads 12 on respective lamp strips 10 are aligned. The flexible strips 14 extend horizontally, so that the repair holes 55 are aligned. The LED beads 12 are distributed in a matrix on the inner side of the back plate 20, so that the light sources are evenly distributed, and moreover, the convenience is brought for mounting each lamp strip 10.

With reference to one of the embodiments, in order to change the emission of light from the direct-type panel lamp 100, within a same lamp strip 10, the LED beads 12 include a plurality of first LED beads 15 and a plurality of second LED beads 16, wherein the first LED beads 15 and the second LED beads 16 are alternately arranged, and the first LED beads 15 and the second LED beads 16 are different in brightness or color temperature (for example, the first LED beads 15 emit white light, and the second LED beads 16 emit yellow light). Alternatively arranging the first LED beads 15 and the second LED beads 16 enables the LED beads 12 be relatively compactly arranged on the lamp strip 10, so that reducing a relatively large space inside the direct-type panel lamp 100 which is occupied by the lamp strip 10.

For a positional relationship between the first LED beads 15 and the second LED beads 16 on the same lamp strip 10, in the same lamp strip 10, with reference to one of the embodiments, the first LED bead 15 and the second LEI) bead 16 which are adjacent to each other form a set of beads. A distance between the first LED bead 15 and the second LED bead 16 in the same set of beads is L1, a distance between two adjacent sets of beads is L2, and the following condition is met: L1:L2=1:2 to 8. Preferably, L1:L2=1:6.

Specifically, L1 ranges from 5 mm to 10 mm and L2 ranges from 20 mm to 40 mm. In this embodiment, L1 is 5 mm, and L2 is 30 mm.

The flexible strip 14 is located between two adjacent sets of beads, and at most one set of beads is arranged between two flexible strips 14. The repair holes 55 are arranged adjacent to a side of the reflective sheet 50, and at most one set of beads is arranged between the repair hole 55 and the side of the reflective sheet 50.

With reference to one of the embodiments, in order to control the first LED beads 15 and the second LED beads 16 independently, all the first LED beads 15 are electrically connected by a first circuit, and all the second. LED beads 16 are electrically connected by a second circuit. There are two flexible strips 14, and the two flexible strips 14 are electrically connected with the first circuit and the second circuit, respectively.

The two repair holes 55 corresponding to the same lamp strip 10 are arranged spaced apart or continuously. When the two repair holes 55 corresponding to the same lamp strip 10 are arranged continuously, the two repair holes 55 and the avoiding holes 54 located between the two repair holes 55 are communicated.

With reference to one of the embodiments, when the two repair holes 55 corresponding to the same lamp strip 10 are arranged continuously, in order to minimize the length of the repair holes 55 (the length direction of the repair holes 55 is the same as the length direction of the lamp strip 10), the flexible strip 14 is located between two adjacent sets of beads, and at most one set of beads is arranged between two flexible strips 14. In this embodiment, one set of beads is arranged between two flexible strips 14.

Preferably, the length of the repair hole 55 ranges from 80 mm to 110 mm. In this embodiment, the length of the repair hole 55 is 90 mm.

In other embodiments, for a positional relationship between the first LED beads 15 and the second LED beads 16 on the same lamp strip 10, in the same lamp strip 10, a distance between two adjacent first LED beads 15 is equal to that between two adjacent second LED beads 16. For any first LED bead 15 and two adjacent second LED beads 16, a distance between the first LED bead 15 and one of the second LED beads 16 is smaller than that between the first LED bead and the other one of the second LED beads 16.

Specifically, in the same lamp strip 10, for any first LED bead 15 and two adjacent second LED beads 16, a distance between the first LED bead 15 and one of the second LED beads 16 is L3, a distance between the first LED bead 15 and the other one of the second LED beads 16 is L4, and the following condition is met: L3:L4=1:1.5 to 6. Preferably, L3:L4=1:2 to 4. In this embodiment, L3 is 5 mm, and L4 is 20 mm.

The substrate 11 may be a metal substrate, preferably an aluminum substrate, or a FR-4 glass fiber board may be selected as the substrate 11. In some embodiments, the substrate 11 may be fixed to a lower surface of the back plate 20 by a screw, and preferably adhered and fixed to the lower surface of the back plate 20 by a thermally conductive glue.

As shown in FIG. 7 to FIG. 11, in some embodiments, the substrate 11 includes a metal layer 111, an insulating layer 112 and a circuit layer 113. The LED beads 12 are soldered on the circuit layer 113. In general, pads 115 for soldering the LED beads 12 is provided on the circuit layer 113. In order to provide the protection for the circuit layer 113, the surface of the substrate 11 is coated with white solder resist ink to form a solder resist layer 144, while openings are formed at the pads 115 to expose the pads 115 for soldering the LED beads 12.

The lenses 13 on the lamp strips 10 are mainly used for diffusing light. The lenses 13 are adhered and fixed on the substrates 11 by epoxy glue or a UV glue. In order to facilitate the mounting of the lenses 13, a protruding leg 131 is disposed on a back surface of each lens 13, and a positioning hole corresponding to the protruding leg is provided in the corresponding substrate 11.

In some embodiments, the flexible strip 14 is pressed on all the lamp strips 10 and intersects with all the lamp strips 10 perpendicularly to facilitate the soldering of the lamp strip 10 with the flexible strip 14. The flexible strip 14 is of a ribbon-shaped structure and includes an insulating layer 142, a circuit layer 143 and a solder resist layer 144, wherein the insulating layer 142 is made of an insulating resin material, and the solder resist layer 144 is formed of white solder resist ink coated on the surface.

In order to realize the connection, a first opening 141 that is not coated with solder resist ink is provided in the edge of the flexible strip 14, and a second opening 114 that is not coated with solder resist ink is provided in a position, which is adjacent to the flexible strip 14, of the substrate 11. Soldering pads are disposed on the two openings and electrically connected by soldering.

The edge region 22 of the back plate 20 form a protruding rib 24 by deforming of the back plate 20, which extends along a side direction of the back plate 20 to increase the strength of the edge region 22. In some embodiments, in order to reduce the processing difficulty of the protruding rib 24, the edge region 22 is bent by itself to form the protruding rib 24. A conventional processing method, such as mechanical stamping, may be adopted for deformation.

The protruding rib 24 presses against the edge of the diffusion plate 30 to make it abut against the first mounting surface 42. Because the back plate 20 has a certain resilience, when the protruding rib 24 presses against the diffusion plate 30, the protruding rib 24 will resiliently deform. As a result, the protruding rib 24 exerts a pressure on the diffusion plate 30, and the protruding rib 24 is corresponding to the first mounting surface 42 to clamp the edge of the diffusion plate 30, so as to prevent the edge of the diffusion plate 30 from bending, thereby preventing a center portion of the diffusion plate 30 (a geometric center of the diffusion plate 30 or a portion near the geometric center of the diffusion plate 30) from collapsing downwards.

In some embodiments, the frame strip 41 is made of metal (such as an aluminum alloy), and end portions of adjacent frame strips 41 are welded and fixed. Certainly, the frame strip 41 may be made of a polymer material by injection molding. Since the polymer material cannot be welded and connected, it is generally necessary to provide corner pieces connecting adjacent frame strips 41 at corners of the frame 40, or adjacent frame strips 41 are in lap joint. However. Such frame 40 has poor flatness compared with a frame formed by welding process.

Figure 6:
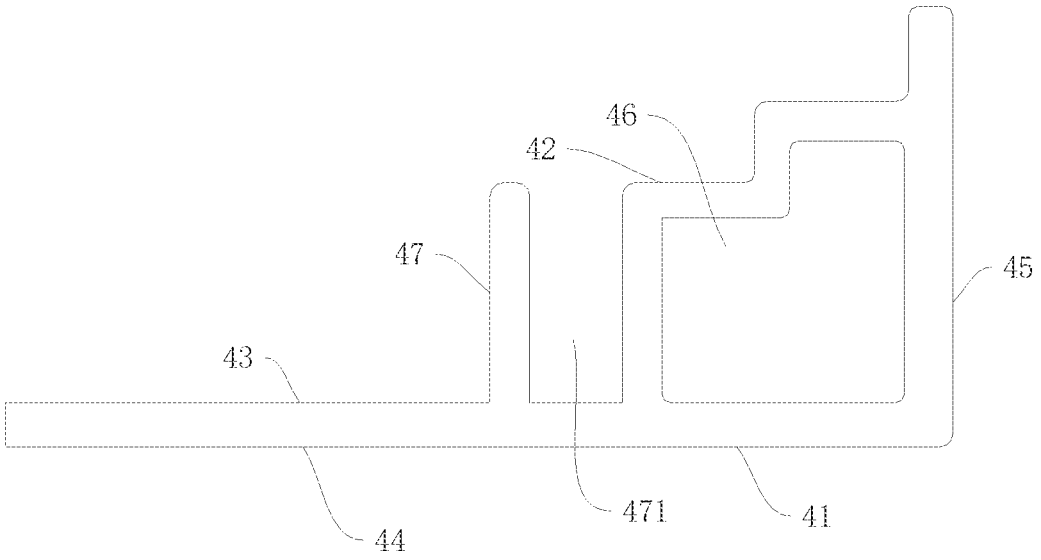
FIG. 6 is a schematic view showing a structure of a frame strip in FIG. 1.
Figure 7:
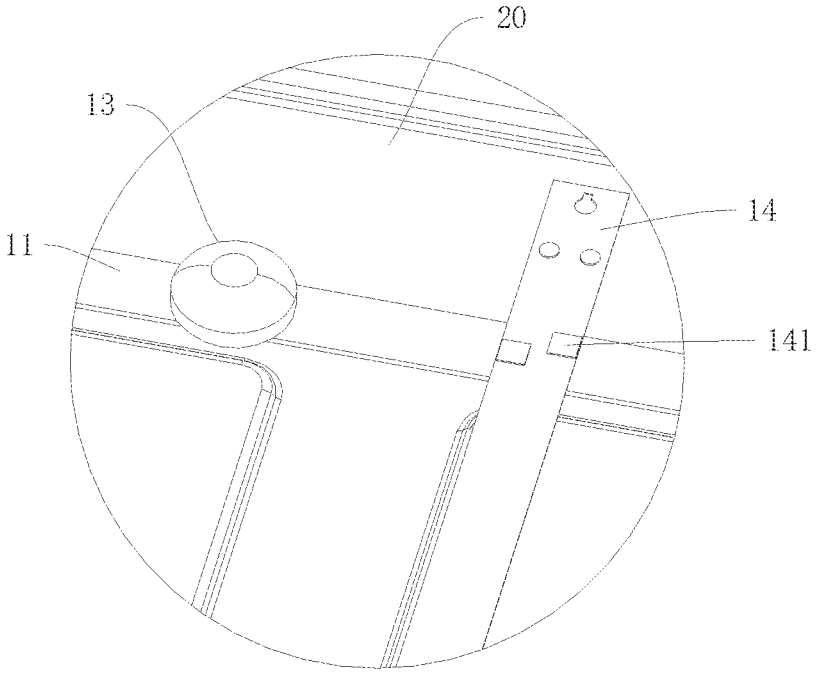
FIG. 7 is a schematic view showing a structure of a connection between lamp strips.
Figure 8:
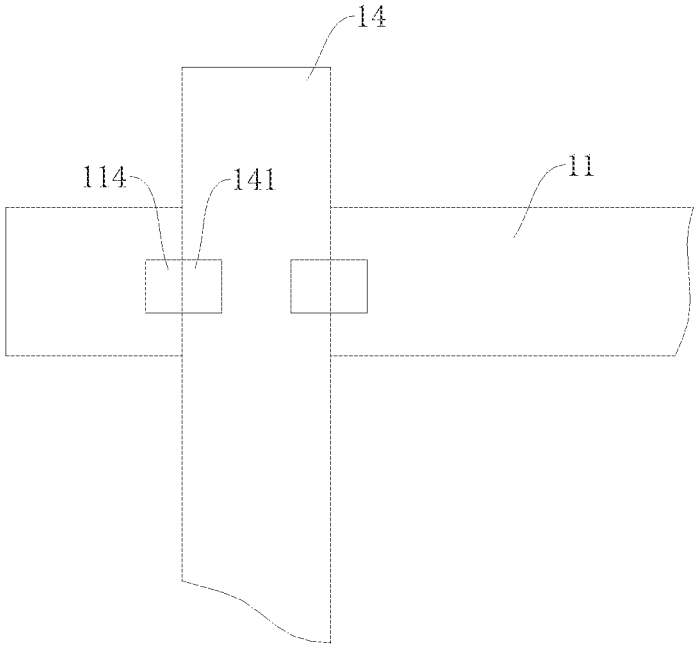
FIG. 8 is a schematic view showing a structure of a connection between a substrate and a flexible strip in FIG. 7.
Figure 9:
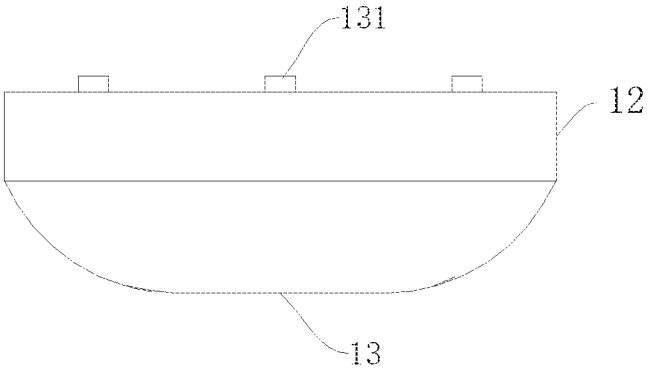
FIG. 9 is a schematic view showing a structure of a LED bead and a lens in FIG. 7.
Figure 10:
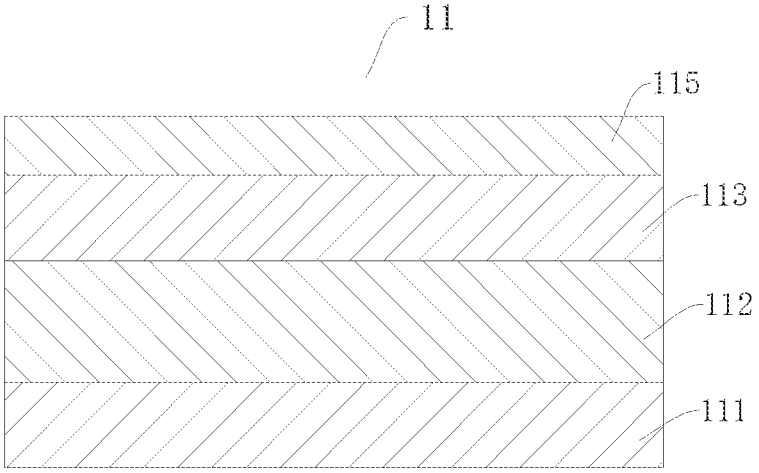
FIG. 10 is a schematic view showing a structure of a circuit board in FIG. 7.
Figure 11:
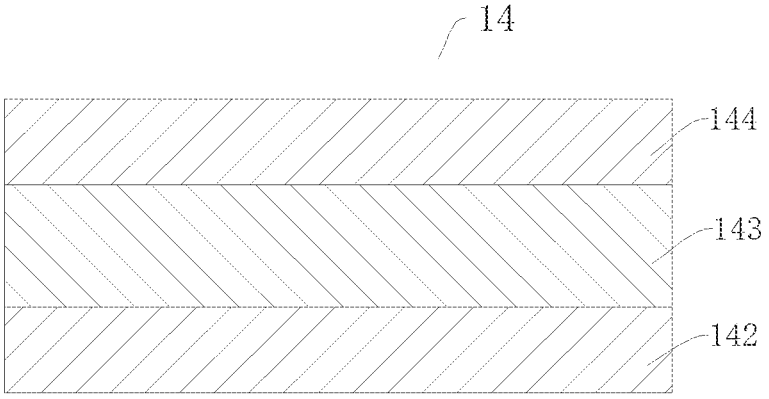
FIG. 11 is a schematic view showing a structure of a flexible strip in FIG. 7.

In some embodiments, as shown in FIG. 5 and FIG. 6, each frame strip 41 has an L-shaped cross section, which includes a horizontal portion 44 and a vertical portion 45. The edge of the diffusion plate 30 and the edge of the back plate 20 are both overlapped on the horizontal portion 44. The vertical portion 45 encloses a defined space for covering connections of the edge of the back plate 20, and plays roles of decoration and a certain protection.

In some embodiments, in order to increase the strength of the profile, the inner side of the corner of the frame strip 41 is thickened to form a thickening portion 46, thereby forming a step structure on the horizontal portion 44. The first mounting surface 42 and the second mounting surface 43 are respectively located on the step structure and the horizontal portion 44. In some embodiments, in order to save the material, the thickening portion is of a hollow structure.

From the perspective of the processing technology and the heat dissipation, the back plate 20 made of a metal plate (for example, ST13) by stamping to form an arched cover structure, so that there is a certain distance between the back plate 20 and the diffusion plate 30 to accommodate the lamp strips 10. In some embodiments, a bottom wall 231 of the back plate 20 is arranged in parallel with the diffusion plate 30. The lamp strips 10 are fixed on the bottom wall 231. The side walls 232 are tangentially connected with the first protruding ribs 24.

In some embodiments, a portion of the edge region 22 which is overlapped on the frame 40 is arranged in parallel with the bottom wall 231, and the bottom wall 231 is higher than the edge region 22. When the direct-type panel lamp 100 is mounted on the ceiling, the bottom wall 231 is arranged horizontally, and the edge region 22 which is overlapped on the frame 40 is arranged horizontally.

In some embodiments, as shown in FIG. 1 and FIG. 2, in order to facilitate the placement of the lamp strip 10, the bottom wall 231 is provided with grooves in which the lamp strips 10 are arranged in a crisscross pattern. In order to facilitate the machining of the groove in the back plate 20, the back plate 20 forms a plurality of protrusions 211 facing away from the chamber 23 by stamping. The grooves are formed between adjacent protrusions 211, and the lamp strips 10 are arranged in parallel. Therefore, the protrusions 211 should be arranged in parallel, and the gap between adjacent protrusions 211 is used to mount the lamp strip 10, so that the lamp strip 10 is generally of a strip-shaped structure. Certainly, the lamp strip may be of a spiral structure.

In some embodiments, the edge region 22 of the back plate 20 is fixed on the frame 40 by screws. In order to facilitate the mounting of the edge region 22, each frame strip 41 is provided with screw grooves 471 arranged along its length direction. In some embodiments, a vertical flange 47 is formed on the middle portion of the upper surface of the horizontal portion 44, the gap between the vertical flange 47 and the step structure serves as the screw groove 471, and the top surface of the vertical flange 47 supports the edge region 22.

In some embodiments, in order to reduce the weight of the back plate 20, the thickness of the back plate 20 ranges from 0.2 mm to 0.4 mm, provided that the supporting strength of the back plate 20 is satisfied. Preferably, the thickness of the back plate 20 is 0.3 min.

In one of the embodiments, in order to make the driving box 60 compact, as shown in FIG. 12, the side length of the first side 64 is equal to that of the third side 642, and the side length of the fourth side 643 is equal to that of the fifth side 642. In this embodiment, the length of the first side 64 and the length of the third side 642 are both 20 mm, the length of the second side 641 is 50 min, and the length of the fourth side 643 and the length of the fifth side 644 are both 30 mm.

In one of the embodiments, as shown in FIG. 12, in order to quickly position the driving box 60, a slope region 25 is formed on an outer peripheral wall of the back plate 20, and a box wall corresponding to the fifth side 644 is corresponding to the slope region 25. Inclination angles of the slope region 25 and a box wall corresponding to the fifth side 644 are the same, and the slope region 25 and the box wall corresponding to the fifth side 644 conform each other. An inclination angle of the fifth side 644 changes with an inclination angle of the slope region 25, and the length of each side of the convex pentagon changes with the inclination angle of the fifth side 644.

In this embodiment, an included angle between the slope region 25 and the vertical axis ranges from 10 degrees to 20 degrees. Preferably, an included angle between the slope region 25 and the vertical axis is 16 degrees.

In order to facilitate the packaging two of the direct-type panel lamps 100, the back plates 20 of the two direct-type panel lamps 100 are placed face to face. Because the driving box 60 is located on the outer periphery of the back plate 20, and the top surface of the driving box 60 is higher than the back plate 20, a box wall corresponding to the fourth side 643 of each driving box 60 abuts against the slope region 25 of the other direct-type panel lamp 100. On the same direct-type panel lamp 100, the slope region 25 is higher than the back plate 20, so that when the two direct-type panel lamps 100 are packaged, the top surface of the driving box 60 will abut against the frame 40 of the other direct-type panel lamp 100. There will be a certain gap between the two back plates 20 to prevent the back plates 20 from deforming.

With reference to one of the embodiments, for a mounting position of the driving box 60, a mounting region (not shown in the figure) is formed between the vertical portion 45 and the outer periphery of the back plate 20, and the driving box 60 is disposed in the mounting region.

Figure 13:
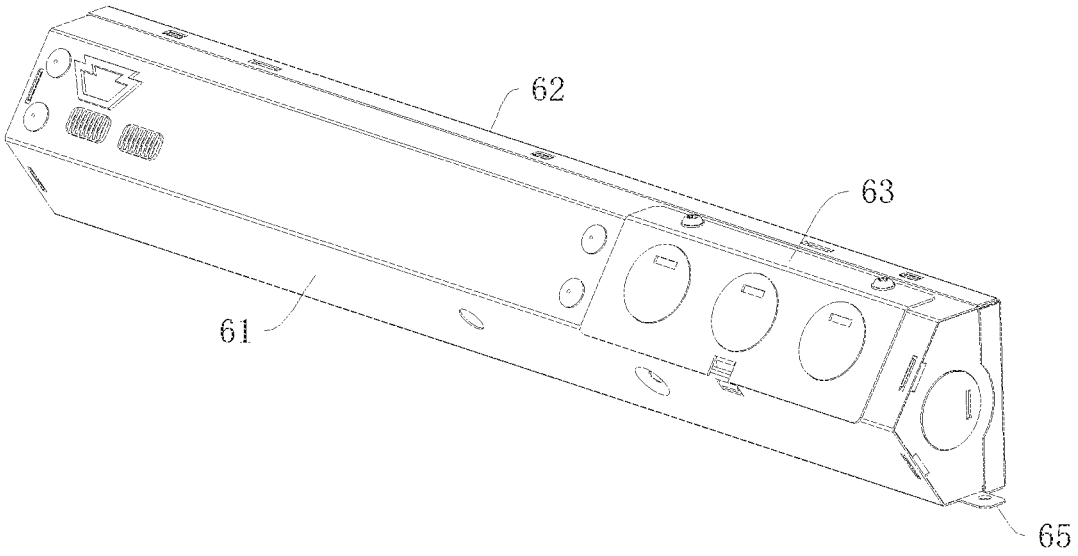
FIG. 13 is a schematic view showing a structure of a driving box in FIG. 12.

With reference to one of the embodiments, as shown in FIG. 13, for a mounting form of the driving box 60, tugs 65 with screw holes are disposed at two ends of the driving box 60, and the lugs 65 are fixed on the frame 40 (screw grooves 471) by fastening screws. The lugs 65 are connected to a box wall corresponding to the first side 64, and bottom surfaces of the lugs 65 are flush with a bottom surface of the box body 61. In order to reduce the difficulty of the processing technology of the lugs 65 and the box body 61 and to enhance the structural strength between the lugs 65 and the box body 61, the lugs 65 and the box body 61 are integrally formed.

With reference to one of the embodiments, as shown in FIG. 13 and FIG. 14, in order to make the through hole for wire 612 avoid the back plate 20 and facilitate the operation of the connecting wires, the through hole for wire 612 is provided in the box wall corresponding to the fourth side 643. The driving box 60 further includes a cover plate 63. The cover plate 63 may avoid affecting the driving module 101 since a foreign matter enters the driving box 60 when the driving box 60 is not in use.

The driving box 60 further includes a cover plate 63, which is mounted on the box body 61 and corresponding to the through hole for wire 612. A plurality of unit holes 631 aligned with the through hole for wire 612 are provided in the cover plate 63. The unit holes 631 may be determined according to the number of the connecting wires, and the connecting wires respectively pass out of the respective unit holes 631 to quickly distinguish the connecting wires.

The cover plate 63 is bent by itself to form a shielding portion 633 and a fixing portion 634. The fixing portion 634 is attached and fixed to the box wall corresponding to the third side 642. The shielding portion 633 is attached to the box wall corresponding to the fourth side 643. Each unit hole 631 is provided in the shielding portion 633.

With reference to one of the embodiments, as shown in FIG. 13 and FIG. 14, a plurality of unit covers 632 are disposed on the cover plate 63, and the plurality of unit covers 632 are respectively arranged in one-to-one correspondence with the unit holes 631. Further, the unit covers 632 are connected with inner edges of the unit holes 631 by deformable connectors (not shown in the figure), and the unit covers 632 may be opened by pushing the unit covers 632.

The driving box 60 is made of a sheet metal to strengthen the structural strength of the driving box 60.

In order to reduce the influence of the driving box 60 on the driving module 101, the direct-type panel lamp 100 further includes an insulating box 66 mounted within the driving box 60, wherein the driving module 101 is mounted within the insulating box 66. By mounting the driving module 101 within the driving box 60, the present application brings the convenience for fixing and protecting the driving module 101, and is capable of simplifying the step of maintaining or replacing the driving module 101, thereby lowering time and labor costs.

The insulating box 66 is of a strip shape, at least one end of the insulating box 66 is opened within the driving box 60, and the opening end is used for allowing the connecting wires of the driving module 101 to pass through. In this embodiment, both ends of the insulating box 66 are open end.

In some embodiments, the insulating box 66 has a rectangular cross section, which is closed in a circumferential direction. In two opposite side walls of the insulating box 66, one of the two opposite side walls of the insulating box 66 is attached and fixed to a side wall of the box body 61, and the other one of the two opposite side walls of the insulating box 66 is fixedly connected with the driving module 101. When the insulating box 66 is fixed on the side wall of the box body 61 by a bolt or riveting, the driving module 101 is capable of avoiding the bolt or a riveting part to reduce the influence of the bolt or the riveting part on the driving module 101.

With reference to one of the embodiments, for the mounting position of the insulating box 66, a length direction of the driving box 60 is consistent with a length direction of the insulating box 66. One end of the insulating box 66 is adjacent to one end portion of the driving box 60, and a wire through chamber 611 is formed between the other end of the insulating box 66 and the other end portion of the driving box 60. The through hole for wire 612 is communicated with the wire through chamber 611. The through hole for wire 612 and the insulating box 66 are located on the same side wall of the box body 61, and the through hole for wire 612 and the insulating box 66 are arranged sequentially along a length direction of the driving box 60.

In some embodiments, in order to form a certain operating space in the wire through chamber 611, the length of the driving box 60 is D1, the length of the insulating box 66 is D2, and the following condition is met: D1:D2=1.5 to 3. Preferably, D1:D2=2

In some embodiments, when the connecting wires of the driving module 101 enters the through hole for wire 612 from one end, which is away from the wire through chamber 611, of the insulating box 66, in order to enable the connecting wire pass through the gap between the driving box 60 and the insulating box 66, the cross-sectional area of the driving box 60 is S1, the cross-sectional area of the insulating box 66 is S2, and the following condition is met: S1:S2=1.2 to 2. Preferably, S1:S2=1.5.

Figure 19:
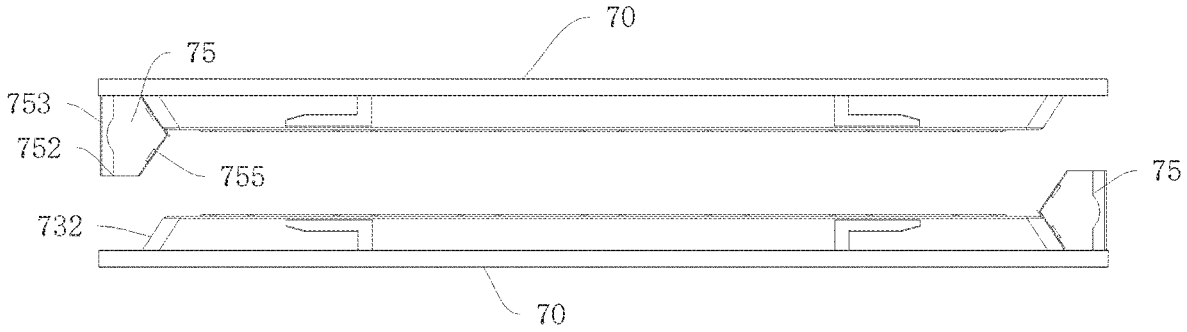
FIG. 19 is a structural schematic view showing the package structure of FIG. 18.

In some of the following embodiments, a package structure is provided, which may be applied to the direct-type panel lamp of the above-mentioned embodiment. For example, in combination with FIG. 19, a driving box in the direct-type panel lamp has two assembling surfaces arranged parallel to each other. The package structure 80 includes two panel lamps 70 with back plates 73 arranged opposite to each other. The two assembling surfaces of each driving box 75 are respectively attached to frames 71 of the two panel lamps 70, and the back plates 73 of the two panel lamps 70 are in contact with each other or arranged with a gap is defined therebetween.

Figure 16:
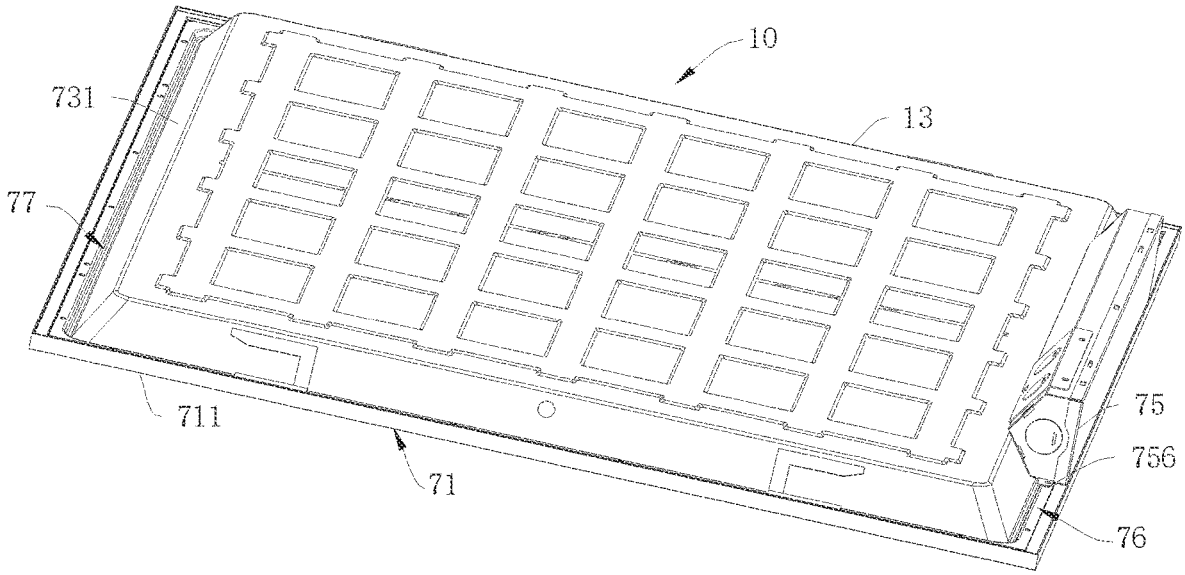
FIG. 16 is a schematic view showing a structure of a panel lamp according to an embodiment provided by the present application.
Figure 17:
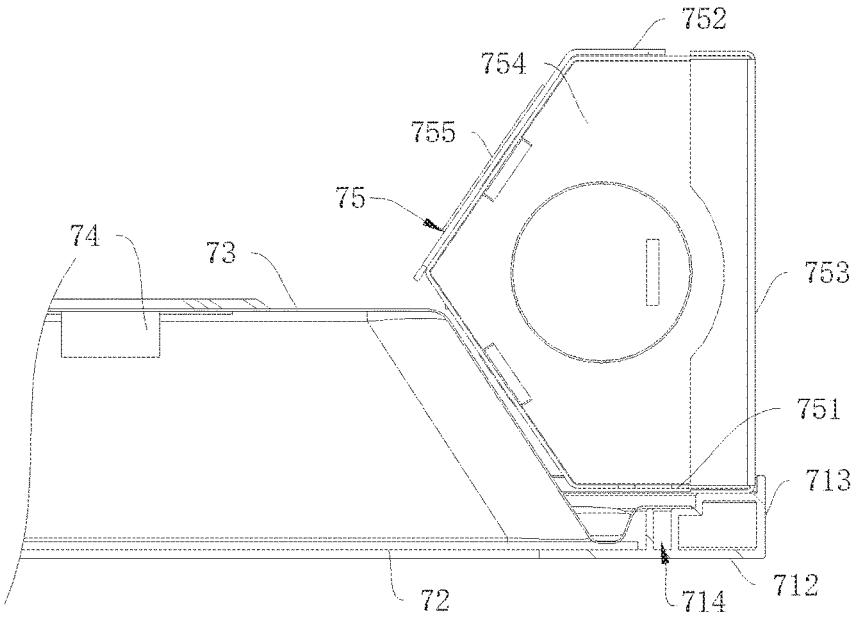
FIG. 17 is a partial structural schematic view showing the panel lamp of FIG. 16.
Figure 18:
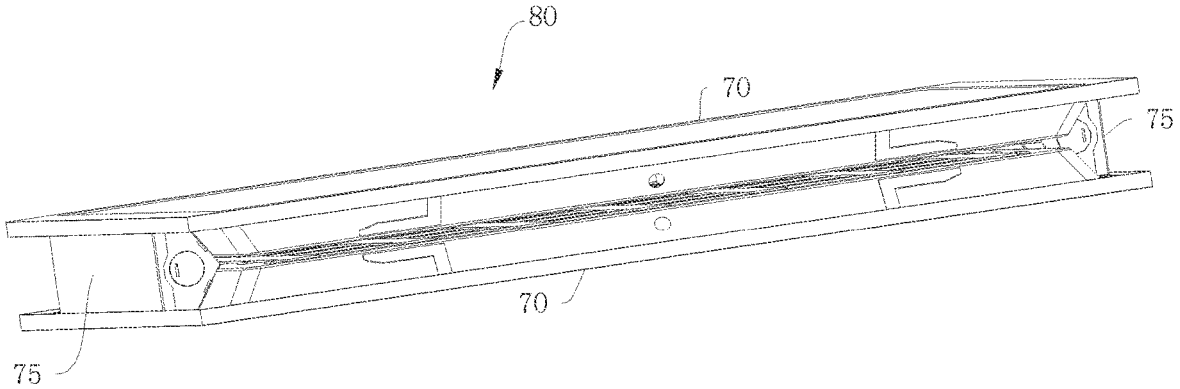
FIG. 18 is a structural schematic view showing a package structure according to an embodiment provided by the present application.

In one of the embodiments, as shown in FIG. 16 to FIG. 17, a panel lamp 70 includes a frame 71, a light transmissive plate 72 mounted on a front side of the frame 71, a back plate 73 mounted on a back side of the frame 71, and a light emitting element 74 disposed between the back plate 73 and the light transmissive plate 72. Light emitted from the light emitting element 74 passes through the light transmissive plate 72. After the light is diffused, a plurality of LED point light sources form a uniform surface light source.

The light transmissive plate 72 may be the diffusion plate of the above-mentioned embodiment, and the light emitting element 74 may be the lamp strip of the above-mentioned embodiment.

In order to enable the panel lamp 70 to work, the panel lamp 70 further includes a driving box 75 fixed on the back side of the frame 71. A driving circuit (not shown in the figure, which is equivalent to the driving module of the above-mentioned embodiment) electrically connected with the light emitting element 74 is mounted within the driving box 75.

The light emitting element 74 is a LED module in this embodiment.

From the perspective of the processing technology and the heat dissipation, the back plate 73 is formed by a sheet metal by stamping. In order to form a certain distance between the back plate 73 and the light transmissive plate 72, a bulging portion 731 is provided on the back plate 73 on one side which faces away from the light transmissive plate 72. The driving box 75 is located on an outer periphery of the bulging portion 731. A top surface of the driving box 75 is higher than the bulging portion 731.

The frame 71 is formed by connected a plurality of (generally, four) frame strips 711. In some embodiments, the frame strips 711 are made of a metal (such as an aluminum alloy), and end portions of adjacent frame strips 711 are welded and fixed. Certainly, the frame strip 711 may be made of a polymer material by injection molding. Since the polymer material cannot be welded and connected, it is generally necessary to provide corner pieces connecting adjacent frame strips 711 at corners of the frame 71, or adjacent frame strips 711 are in lap joint. However, such frame 71 has poor flatness compared with a frame formed by welded process.

In another embodiment, a mounting region 76 and an accommodating region 77 are formed between the frame 71 and the back plate 73, and the mounting region 76 is configured to mount the driving box 75.

Preferably, an accommodating region 77 and a mounting region 76 are arranged on opposite sides of the panel lamp 70, and the mounting region 76 is configured for mounting the driving box 75.

Each frame strip 711 has an L-shaped cross section, including a horizontal portion 712 and a vertical portion 713, and the edge of the back plate 73 and the edge of the light transmissive plate 72 are overlapped on the horizontal portion 712, and a mounting region 76 and an accommodating region 77 are formed between the vertical portion 713 and the outer periphery of the bulging portion.

In some embodiments, a screw groove 714 arranged along a length direction of the frame strip 711 is formed on the horizontal portion 712. The back plate 73 is fixed to the frame 71 by means of cooperation of a screw and the screw groove 714.

In another embodiment, a bottom surface of the driving box 75 is attached to the horizontal portion 712 and fixed to the horizontal portion 712 by a screw. In order to facilitate the assembly, the driving box 75 is fixed by a screw engaged in the screw groove 714.

The driving box 75 is provided with a through hole for wire through which a connecting wire of a driving circuit passes. When the driving circuit is replaced or maintained, it is only necessary to take the driving circuit out of the driving box 75, thus simplifying the step of maintaining or replacing the driving circuit.

Lugs 756 extending towards the outside of the driving box 75 are formed on two ends of the driving box 75. The lugs 756 are fixed on the horizontal portion 712 by screws. Bottom surfaces of the lugs 756 are flush with the bottom surface of the driving box 75.

In order to reduce the processing difficulty between the lugs 756 and the driving box 75, and to enhance the structural strength between the lugs 756 and the driving box 75, the lugs 756 and the driving box 75 are integrally formed.

In another embodiment, the driving box 75 has two assembling surfaces parallel relative to each other and a positioning surface 753 disposed between the two assembling surfaces. The two assembling surfaces includes a first assembling surface 751 and a second assembling surface 752. The first assembling surface 751 is attached to the horizontal portion 712 of the frame 71. The positioning surface 753 is attached to the inner side of the edge of the frame 71.

In another embodiment, as shown in FIGS. 16 to 19, the package structure 80 includes two panel lamps 70 with back plates 73 placed opposite to each other. The two assembling surfaces of each driving box 75 are respectively attached to the frames 71 of the two panel lamps 70. The back plates 73 of the two panel lamps 70 are in contact with each other or arranged with a gap formed between the back plates 73 of the two panel lamps 70.

When the two panel lamps 70 are packaged, the second assembling surface 752 of each driving box 75 is attached to the frame 71 of the other panel lamp 70 in the accommodating region 77. An action force between the two panel lamps 70 is borne by the two driving boxes 75, so as to prevent the back plates 73 of the two panel lamps 70 from deforming due to the action force.

In order to make the package structure 80 more compact, a gap distance between the back plates 73 of the two panel lamps 70 is less than 10 mm.

Meanwhile, in order to increase the stability of the package structure 8, the driving boxes 75 of the two panel lamps 70 are respectively located on two opposite sides of the package structure 80.

In some embodiments, when the two panel lamps 70 are packaged, the accommodating region 77 is configured to accommodate the driving box 75 on the other panel lamp 70. At this time, the positioning surface 753 is attached to inner sides of edges of the frames 71 of the two panel lamps 70.

In order to locate a position between the two panel lamps 70 in the package structure 80, the driving box 75 has an abutting portion 754 higher than the bulging portion 731 of the panel lamp 70. The second assembling surface 752 is located at a top surface of the abutting portion 754. One side of the abutting portion 754 which faces the center of the frame 71 serves as a limiting surface 755, One panel lamp 70 abuts against an outer peripheral wall of the bulging portion 731 of the other panel lamp by the limiting surface 755 thereon. In combination with the above-mentioned embodiment, the driving box 75 has a pentagonal cross section, and the first assembling surface 751, the second assembling surface 752, the positioning surface 753 and the two limiting surfaces 755 are corresponding to sides of the pentagon, respectively.

In order to further locate a position between the two panel lamps 70 in the package structure 8, a slope region 732 is formed on an outer peripheral wall of the bulging portion 731, and the slope region 732 is corresponding to the limiting surface 755 of the other panel lamp.

Preferably, inclination angles between the slope regions 732 and the limiting surfaces 755 which are corresponding to each other are the same, and the slope regions 732 and the limiting surfaces 755 conform one another.

In this embodiment, an included angle between the slope region 732 and the vertical axis ranges from 10 degrees to 20 degrees. Preferably, the included angle between the slope region 732 and the vertical axis is 16 degrees.

The technical features of the above embodiments may be combined arbitrarily. For brevity of description, all possible combinations of the technical features in the above embodiments are not described. However, the combinations of these technical features should be considered as the range described in this specification in any way if they are not contradictory. When the technical features of different embodiments are embodied in the same accompanying drawing, it should be considered that the accompanying drawing discloses combination examples of the various embodiments involved.

The above embodiments only present a few implementation modes of the present application, with a relatively specific and detailed description. However, they should not be understood as a limitation on the scope of the patent application. It should be noted that for those ordinarily skilled in the art, a number of modifications and improvements may be made without departing from the concept of the present application, and all the modifications and improvements fall within the protection scope of the present application.

What is claimed is:

1. A direct-type panel lamp with a driving box, comprising:

at least one lamp strip, comprising a substrate and a plurality of LED beads fixed on the substrate;

a back plate, with a central region bulging to form a chamber for accommodating the lamp strip, the chamber comprises a flat bottom wall and a plurality of inclined side walls, and each lamp strip is fixed on the bottom wall;

a diffusion plate, having a light transmitting function, and arranged opposite to the back plate to close the chamber;

a frame, formed by connecting a plurality of frame strips, and each frame strip is connected with respective edges of the diffusion plate and the back plate; and a driving box, configured to receive a driving module electrically connected to the lamp strip, the driving box comprises a box body with an opening and a top cover buckled to the opening of the box body, and the box body is provided with a through hole for a wire through which a connecting wire of the driving module passes;

wherein the box body is arranged in a strip shape, having a convex pentagonal cross section, the convex pentagon comprises a first side, a second side, a third side, a fourth side and a fifth side which are arranged in sequence, wherein the first side is arranged parallel to the third side, the second side is perpendicular to the first side and the third side, and a box wall corresponding to the first side is attached to the frame, and a box wall corresponding to the fifth side is attached to the back plate.

2. The direct-type panel lamp with a driving box according to claim 1, wherein the first side has a length equal to a length of the third side, and the fourth side has a length equal to the length of the fifth side.

3. The direct-type panel lamp with a driving box according to claim 1, wherein the back plate is provided with a slope region on an outer periphery thereof, and a box wall corresponding to the fifth side is corresponding to the slope region.

4. The direct-type panel lamp with a driving box according to claim 3, wherein an angle of inclination of the slope region and an angle of inclination of the box wall corresponding to the fifth side are the same, and the slope region and the box wall corresponding to the fifth side conform to each other.

5. The direct-type panel lamp with a driving box according to claim 1, wherein the driving box is located on an outer periphery of the back plate, and a top surface of the driving box is higher than the back plate.

6. The direct-type panel lamp with a driving box according to claim 1, wherein lugs with screw holes are disposed on two ends of the driving box; and wherein the lugs are connected to a box wall corresponding to the first side.

7. The direct-type panel lamp with a driving box according to claim 1, wherein the through hole for the wire is provided in the box wall corresponding to the fourth side;

the driving box further comprises a cover plate mounted on the box body and corresponding to the through hole for the wire, and a plurality of unit holes aligned with the through hole for the wire are provided in the cover plate.

8. The direct-type panel lamp with a driving box according to claim 7, wherein a plurality of unit covers are further disposed on the cover plate, and the plurality of unit covers are respectively arranged corresponding to the unit holes;

the unit covers are connected with inner edges of the unit holes by deformable connectors.

9. The direct-type panel lamp with a driving box according to claim 1, further comprising an insulating box mounted within the driving box, wherein the driving module is mounted within the insulating box.

10. The direct-type panel lamp with a driving box according to claim 1, wherein the frame strip has an L-shaped cross section, comprising a horizontal portion and a vertical portion, a mounting region is formed between the vertical portion and an outer periphery of the back plate, and the driving box is disposed in the mounting region.

11. A package structure of a panel lamp, wherein the panel lamp is the direct-type panel lamp according to claim 1, wherein the driving box has two assembling surfaces arranged parallel to each other; and the package structure comprises two panel lamps with back plates placed opposite to each other, the two assembling surfaces of the driving box of each panel lamp are respectively attached to the frames of the two panel lamps, and the back plates of the two panel lamps are in contact with each other or arranged with a gap formed between the back plates of the two panel lamps, wherein a gap distance is less than 10 mm.

12. A package structure for a panel lamp, wherein the panel lamp comprises a frame, a light transmissive plate mounted on a front side of the frame, a back plate mounted on a back side of the frame, and a light emitting element arranged between the back plate and the light transmissive plate; and the panel lamp further comprises a driving box fixed on the back side of the frame, wherein the driving box is provided with a driving circuit electrically connected with the light emitting element, and the driving box has two assembling surfaces arranged parallel to each other; and the package structure comprises two panel lamps with back plates placed opposite to each other, the two assembling surfaces of each driving box are attached to the frames of the two panel lamps, the back plates of the two panel lamps are in contact with each other or arranged with a gap formed between the back plates, wherein a gap distance is less than 10 mm.

13. The package structure of a panel lamp according to claim 12, wherein the driving box further has a positioning surface disposed between the two assembling surfaces, and the positioning surface is attached to inner sides of edges of the frames of the two panel lamps.

14. The package structure of a panel lamp according to claim 13, wherein the back plate is provided with a bulging portion on one side which faces away from the light transmissive plate, and the driving box is located on an outer periphery of the bulging portion and a top surface of the driving box is higher than the bulging portion.

15. The package structure of a panel lamp according to claim 14, wherein the driving box has an abutting portion higher than the bulging portion of the panel lamp, one side of the abutting portion which faces the center of the frame serves as a limiting surface, and one panel lamp abuts against an outer periphery of the bulging portion of the other panel lamp at a limiting surface on the driving box thereof.

16. The package structure of a panel lamp according to claim 15, wherein a mounting region and an accommodating region are formed between the frame and the back plate of each panel lamp, the mounting region is configured to mount the driving box of one panel lamp, and the accommodating region is configured to accommodate a driving box of an other panel lamp.

17. The package structure of a panel lamp according to claim 16, wherein the accommodating region and the mounting region are communicated with each other in an annular arrangement.

18. The package structure of a panel lamp according to claim 17, wherein each frame is formed by connecting a plurality of frame strips, each frame strip has an L-shaped cross section, comprising a horizontal portion and a vertical portion, and the edge of the back plate and the edge of the light transmissive plate are overlapped on the horizontal portion, the mounting region and the accommodating region are formed between the vertical portion and an outer periphery of the bulging portion.

19. The package structure of a panel lamp according to claim 18, wherein the driving boxes of the two panel lamps are respectively located on two opposite sides of the package structure.

* * * * *